US009821584B2

(12) United States Patent
Noguchi et al.

(10) Patent No.: US 9,821,584 B2
(45) **Date of Patent: *Nov. 21, 2017**

(54) IMAGE RECORDING METHOD

(71) Applicant: CANON KABUSHIKI KAISHA, Tokyo (JP)

(72) Inventors: Mitsutoshi Noguchi, Kawaguchi (JP); Yuichiro Kanasugi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

This patent is subject to a terminal disclaimer.

(21) Appl. No.: 14/301,844

(22) Filed: Jun. 11, 2014

(65) Prior Publication Data

US 2014/0370193 A1 Dec. 18, 2014

(30) Foreign Application Priority Data

Jun. 14, 2013 (JP) ..... 2013-125710

(51) Int. Cl.
*B41M 5/035* (2006.01)
*B41M 5/025* (2006.01)

(52) U.S. Cl.
CPC ..... *B41M 5/0356* (2013.01); *B41M 5/0256* (2013.01)

(58) Field of Classification Search
CPC ..... B41M 5/0256; B41M 5/0356
See application file for complete search history.

(56) References Cited

U.S. PATENT DOCUMENTS 5,554,212 A * 9/1996 Bui ..... C09D 11/30 106/31.36
5,623,296 A * 4/1997 Fujino ..... B41J 2/0057 347/100
9,145,022 B2 * 9/2015 Imai ..... B41M 5/025
9,180,658 B2 * 11/2015 Kanasugi ..... B41J 2/0057
2005/0110856 A1 * 5/2005 Mouri ..... B41J 2/0057 347/103
2008/0280044 A1 * 11/2008 Okamura ..... C09D 11/324 427/258

FOREIGN PATENT DOCUMENTS

JP 7-32721 A 2/1995

* cited by examiner

*Primary Examiner* — James M Mellott
(74) *Attorney, Agent, or Firm* — Canon U.S.A. Inc., IP Division

(57) ABSTRACT

An image recording method includes an intermediate image-forming step of forming an intermediate image by applying an ink to an intermediate transfer body, a temperature adjusting step, and a transfer step of transferring the intermediate image onto a recording medium in this order. The ink contains polymer particles and a surfactant which is at least one selected from a compound represented by general formula (1) and a compound represented by general formula (2). In the temperature adjusting step, a temperature of the intermediate image is adjusted to a temperature higher than or equal to a minimum film-forming temperature of the polymer particles. A temperature of the intermediate image in the transfer step is lower than the minimum film-forming temperature of the polymer particles.

10 Claims, 1 Drawing Sheet

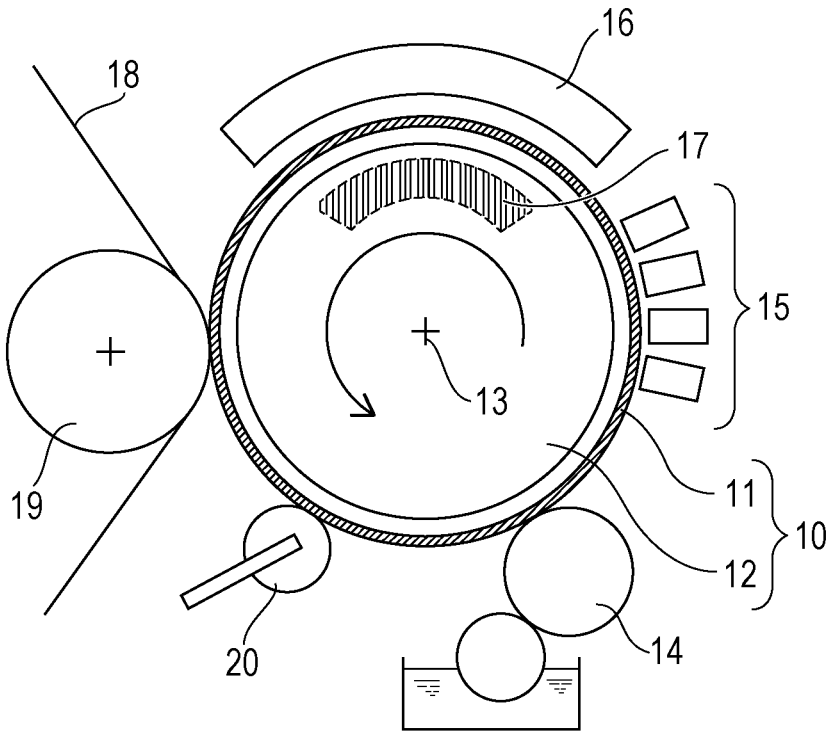
16
18
17
15
13
19
11
10
12
20
14

IMAGE RECORDING METHOD

BACKGROUND OF THE INVENTION

Field of the Invention

The present invention relates to an image recording method.

Description of the Related Art

There has been known an image recording method with which ink is applied to an intermediate transfer body to record an intermediate image and the intermediate image is transferred onto a recording medium (hereinafter, this method may also be referred to as "intermediate transfer-type image recording method"). In recent years, with the increasing demand for high-speed recording, intermediate transfer-type image recording methods with which high-quality images are obtained even at a high transfer speed have been studied. In intermediate transfer-type image recording methods, the efficiency of transferring intermediate images formed on intermediate transfer bodies onto recording media significantly affects the quality of images obtained. Typically, in order to improve the transfer efficiency, an approach of using an ink that contains polymer particles has been studied (refer to Japanese Patent Laid-Open No. 7-32721). Japanese Patent Laid-Open No. 7-32721 discloses that the transfer efficiency is improved by using an ink that contains polymer particles having a minimum film-forming temperature of 50° C. or higher and heating the ink to a temperature higher than or equal to the minimum film-forming temperature during transfer.

SUMMARY OF THE INVENTION

An image recording method according to an embodiment of the present invention includes an intermediate image-forming step of forming an intermediate image by applying an ink to an intermediate transfer body, a temperature adjusting step, and a transfer step of transferring the intermediate image onto a recording medium in this order. The ink contains polymer particles and a surfactant which is at least one selected from a compound represented by general formula (1) below and a compound represented by general formula (2) below. In the temperature adjusting step, a temperature of the intermediate image is adjusted to a temperature higher than or equal to a minimum film-forming temperature of the polymer particles. A temperature of the intermediate image in the transfer step is lower than the minimum film-forming temperature of the polymer particles.

General formula (1)

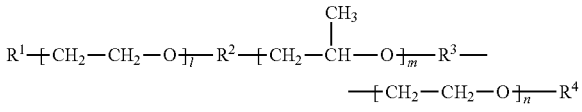

In the general formula (1), $R^1$ and $R^4$ each independently represent a hydrogen atom or an organic group, $R^2$ and $R^3$ each independently represent a single bond or an organic group, l and n each independently represent 0 or more, l +n represents 2 or more and 300 or less, and m represents 1 or more and 70 or less.

General formula (2)

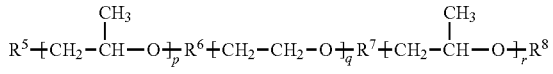

In the general formula (2), $R^5$ and $R^8$ each independently represent a hydrogen atom or an organic group, $R^6$ and $R^7$ each independently represent a single bond or an organic group, p and r each independently represent 0 or more, p+r represents 2 or more and 70 or less, and q represents 1 or more and 300 or less.

Further features of the present invention will become apparent from the following description of exemplary embodiments with reference to the attached drawing.

BRIEF DESCRIPTION OF THE DRAWING

FIGURE is a schematic view illustrating an example of a structure of a recording apparatus used in an embodiment of the present invention.

DESCRIPTION OF THE EMBODIMENTS

According to the studies conducted by the inventors of the present invention, when recording is performed at a high transfer speed using the ink containing polymer particles and described in Japanese Patent Laid-Open No. 7-32721, a high-quality image is not formed. In particular, the transfer efficiency for recording media having high surface roughness is low. This is because, during transfer, recording media having high surface roughness have a smaller number of contact points with an intermediate image formed on an intermediate transfer body than smooth recording media having low surface roughness.

Accordingly, the present invention provides an image recording method with which a high-quality image is formed with a high transfer efficiency even when recording is performed on a recording medium having high surface roughness at a high transfer speed.

The present invention will now be described in detail using embodiments. First, the inventors of the present invention have studied the properties desirable for achieving high transfer efficiency in intermediate transfer-type image recording methods. As a result, it has been found that it is important to have both of the following properties: (i) that the intermediate image is robust and (ii) that the adhesion of the intermediate image to a recording medium is high. By satisfying the property (i), occurrence of partial transfer of the intermediate image during the transfer from the intermediate transfer body to the recording medium is suppressed. By satisfying the property (ii), transfer of the intermediate image onto the recording medium is facilitated.

The inventors have conducted studies on conditions required to satisfy the properties (i) and (ii) and finally have found a structure according to an embodiment of the present invention. Specifically, the image recording method includes an intermediate image-forming step of forming an intermediate image by applying an ink to an intermediate transfer body, the ink containing polymer particles and at least one surfactant selected from a surfactant represented by general formula (1) below and a surfactant represented by general formula (2) below (hereafter may also be referred to as "surfactants represented by general formulae (1) and/or (2)"); a temperature adjusting step of adjusting a temperature of the intermediate image to a temperature higher than or equal to a minimum film-forming temperature of the polymer particles; and a transfer step of transferring the intermediate image onto a recording medium at a temperature lower than the minimum film-forming temperature of the polymer particles.

General formula (1)

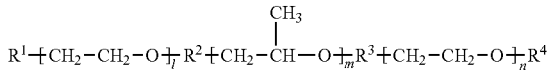

In the general formula (1), $R^1$ and $R^4$ each independently represent a hydrogen atom or an organic group, $R^2$ and $R^3$ each independently represent a single bond or an organic group, l and n each independently represent 0 or more, l +n represents 2 or more and 300 or less, and m represents 1 or more and 70 or less.

General formula (2)

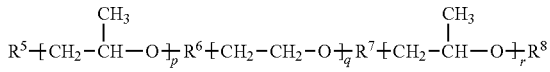

In the general formula (2), $R^5$ and $R^8$ each independently represent a hydrogen atom or an organic group, $R^6$ and $R^7$ each independently represent a single bond or an organic group, p and r each independently represent 0 or more, p+r represents 2 or more and 70 or less, and q represents 1 or more and 300 or less.

The mechanism with which the advantageous effects of the present invention are achieved by this structure will be described below.

The surfactants represented by the general formulae (1) and (2) above exhibit surface activity because they have an ethylene oxide structure ($CH_2CH_2O$) having high hydrophilicity and a propylene oxide structure ($CH_2CH(CH_3)O$) having low hydrophilicity. However, the structure of such surfactants is not a structure in which hydrophilicity or hydrophobicity is definitely present as in typical surfactants, and thus such surfactants have relatively low surface activity. Therefore, when the surfactants are present together with polymer particles, the surfactants tend to be dissolved in an aqueous medium in the intermediate image or adsorbed onto the polymer particles rather than being aligned at a gas-liquid interface. Herein, the polymer particles contained in the intermediate image are attached to each other through the surfactants that have adsorbed onto the polymer particles, and thus the entire intermediate image becomes robust (the property (i)). Furthermore, in the present invention, the temperature of the intermediate image is adjusted to a temperature higher than or equal to the minimum film-forming temperature of the polymer particles, whereby the polymer particles are softened once and formed into a film. The temperature of the intermediate image is adjusted to a temperature lower than the minimum film-forming temperature during transfer, whereby an intermediate image formed in the form of a soft film is solidified, which can further improve the strength of the intermediate image (the property (i)).

It has been also found that the adhesiveness generated when the polymer particles and the recording medium are brought into contact with each other is further improved (the property (ii)). This may be because the surfactants represented by the general formulae (1) and/or (2) that have adsorbed onto the polymer particles have a high affinity for the recording medium and thus the polymer particles easily move to the recording medium side.

As described above, the properties (i) and (ii) can be satisfied by satisfying the components and the steps of the present invention. As a result, high transfer efficiency is achieved.

The synergistic effects of the components and the steps are produced through the mechanisms described above, whereby the advantageous effects of the present invention can be achieved.

Image Recording Method

An image recording method according to an embodiment of the present invention includes an intermediate image-forming step of forming an intermediate image by applying an ink to an intermediate transfer body, the ink containing polymer particles and surfactants represented by general formulae (1) and/or (2); a temperature adjusting step of adjusting the temperature of the intermediate image to a temperature higher than or equal to the minimum film-forming temperature of the polymer particles; and a transfer step of transferring the intermediate image onto a recording medium at a temperature lower than the minimum film-forming temperature of the polymer particles.

FIGURE is a schematic view illustrating an example of an image recording apparatus used in the image recording method according to an embodiment of the present invention. In the image recording apparatus illustrated in FIGURE, an intermediate transfer body 10 includes a drum-shaped rotatable supporting member 12 and a top layer member 11 disposed on an outer peripheral surface of the supporting member 12. The intermediate transfer body 10 (supporting member 12) rotates about a rotation axis 13 in a direction indicated by an arrow (counterclockwise in the drawing). Components disposed around the intermediate transfer body 10 are configured to operate in synchronization with the rotation of the intermediate transfer body 10. When the image recording method includes a step of applying a liquid composition to the intermediate transfer body 10, the liquid composition may be applied to the intermediate transfer body 10 with an application roller 14 or the like. An ink is ejected from an inkjet recording head 15 and consequently an intermediate image, which is a mirror reflected image of an intended image, is formed on the intermediate transfer body 10. Subsequently, the temperature of the intermediate image formed on the intermediate transfer body 10 is adjusted to a desired temperature with a temperature-adjusting mechanism 17. Herein, a liquid in the intermediate image formed on the intermediate transfer body 10 may be removed with a liquid-removing mechanism 16. Although not illustrated in the drawing, a mechanism for cooling the intermediate image may be employed. Subsequently, after the temperature of the intermediate image reaches a temperature lower than the minimum film-forming temperature of the polymer particles, a recording medium 18 is brought into contact with the intermediate transfer body 10 using a pressure roller 19 to transfer the intermediate image onto the recording medium 18. A cleaning unit 20 may be disposed to perform a step of cleaning the surface of the intermediate transfer body 10.

Each of the steps of the image recording method according to an embodiment of the present invention will be described below in detail. Note that "(meth)acrylic acid" is hereafter referred to as "acrylic acid" and "methacrylic acid" and "(meth)acrylate" is hereafter referred to as "acrylate" and "methacrylate".

Intermediate Image-Forming Step

In the image recording method according to an embodiment of the present invention, the intermediate image-forming step includes applying an ink to the intermediate transfer body. An inkjet method can be used as a method for applying an ink to the intermediate transfer body. In particular, a method in which an ink is ejected from an ejection orifice of a recording head by the action of thermal energy to the ink can be used.

For example, a line head or a serial head can be used as the inkjet recording head. In the line head, ink ejection orifices are arranged in a direction (axial direction in a drum shape) perpendicular to the rotational direction of the intermediate transfer body. The serial head is a head that performs recording by scanning the intermediate transfer body in a direction perpendicular to the rotational direction of the intermediate transfer body.

Intermediate Transfer Body

In the present invention, the intermediate transfer body is a base which retains a liquid composition and an ink and on which an intermediate image is to be recorded. For example, the intermediate transfer body includes a supporting member that conveys a required force by handling the intermediate transfer body itself and a top layer member on which an intermediate image is to be recorded. Note that the supporting member and the top layer member may be integrally provided.

Examples of the shape of the intermediate transfer body include a sheet-like shape, a roller-like shape, a drum-like shape, a belt-like shape, and an endless web shape. The size of the intermediate transfer body can be suitably set in accordance with the size of a recording medium that can be recorded.

The supporting member of the intermediate transfer body is required to have a certain level of strength from the viewpoint of the conveyance accuracy and durability. The supporting member can be composed of, for example, a metal, a ceramic, or a resin. In particular, the supporting member can be composed of aluminum, iron, stainless steel, acetal resin, epoxy resin, polyimide, polyethylene, polyethylene terephthalate, nylon, polyurethane, silica ceramic, or alumina ceramic. When the supporting member is composed of such a material, high rigidity and high dimensional accuracy can be achieved even when pressure is applied during transfer, and furthermore the inertia during operation is suppressed and the responsiveness for control can be improved. These materials can be used alone or in combination of two or more.

In the intermediate transfer body, an intermediate image is transferred onto a recording medium such as paper by applying pressure, and thus the top layer of the intermediate transfer body needs to have a certain level of elasticity. For example, when paper is used as a recording medium, the Duro A hardness (Durometer, type A hardness) of the top layer of the intermediate transfer body, which is in conformity with JIS K 6253, is preferably degrees or more and 100 degrees or less and more preferably 20 degrees or more and 60 degrees or less. A top layer member constituting the top layer of the intermediate transfer body can be composed of, for example, a metal, a ceramic, or a resin. In particular, the top layer member can be composed of polybutadiene rubber, nitrile rubber, chloroprene rubber, silicone rubber, fluorocarbon rubber, fluorosilicone rubber, urethane rubber, styrene elastomer, olefin elastomer, vinyl chloride elastomer, ester elastomer, amide elastomer, polyether, polyester, polystyrene, polycarbonate, a siloxane compound, or a perfluorocarbon compound. The top layer member may be formed by stacking a plurality of materials. For example, the top layer member may be formed by stacking silicone rubber on an endless belt-shaped urethane rubber sheet, stacking silicone rubber on a polyethylene terephthalate film, or forming a film composed of a siloxane compound on a urethane rubber sheet.

The surface of the intermediate transfer body may be subjected to a surface treatment. Examples of the surface treatment include a flame treatment, a corona treatment, a plasma treatment, a polishing treatment, a roughening treatment, an active-energy-ray irradiation treatment, an ozone treatment, a surfactant treatment, and a silane coupling treatment. These treatments may be combined with each other.

From the viewpoint of suppressing the flow of an intermediate image on the intermediate transfer body, the arithmetic mean roughness of the surface of the intermediate transfer body, which is defined in JIS B 0601:2001, can be 0.01 μm or more and 3 μm or less. Furthermore, the contact angle of water on the surface of the intermediate transfer body is preferably 50 degrees or more and 110 degrees or less and more preferably 60 degrees or more and 100 degrees or less.

Ink

An ink used in the image recording method according to an embodiment of the present invention contains polymer particles and the surfactants represented by the general formulae (1) and/or (2).

Surfactants Represented by General Formulae (1) and (2)

The surfactant represented by general formula (1) in the present invention is a block copolymer including an ethylene oxide structure and a propylene oxide structure.

General formula (1)

$$R^1\text{-}\left(CH_2\text{-}CH_2\text{-}O\right)_l R^2\left(CH_2\text{-}\overset{\overset{\displaystyle CH_3}{|}}{C}H\text{-}O\right)_m R^3\left(CH_2\text{-}CH_2\text{-}O\right)_n R^4$$

In the general formula (1), $R^1$ and $R^4$ each independently represent a hydrogen atom or an organic group. When $R^1$ and $R^4$ represent organic groups, each of the organic groups can be a hydroxyl group or a hydrocarbon group having 1 to 10 carbon atoms. When $R^1$ and $R^4$ represent hydrocarbon groups, each of the hydrocarbon groups may be linear or branched, but can be particularly linear. $R^1$ and $R^4$ preferably each independently represent a hydrogen atom, a hydroxyl group, or an alkyl group having 1 to 10 carbon atoms and more preferably each independently represent a hydrogen atom, a hydroxyl group, or a methyl group.

In the general formula (1), $R^2$ and $R^3$ each independently represent a single bond or an organic group. When $R^2$ and $R^3$ represent organic groups, each of the organic groups can be a divalent hydrocarbon group having 1 to 10 carbon atoms. When $R^2$ and $R^3$ represent hydrocarbon groups, each of the hydrocarbon groups may be linear or branched, but can be particularly linear. $R^2$ and $R^3$ preferably each independently represent a single bond or an alkylene group having 1 to 10 carbon atoms, more preferably each independently represent a single bond or a methylene group, or particularly preferably each independently represent a single bond.

In the general formula (1), l and n each independently represent 0 or more and l +n represents 2 or more and 300 or less. Furthermore, l +n preferably represents 2 or more and 80 or less and more preferably 3 or more and 27 or less.

In the general formula (1), m represents 1 or more and 70 or less. Furthermore, m preferably represents 10 or more and 60 or less and more preferably 16 or more and 31 or less.

In the present invention, the surfactant represented by the general formula (1) can be a surfactant represented by general formula (1-A) below.

General formula (1-A)

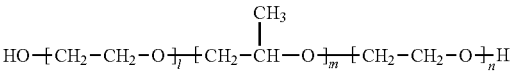

In the general formula (1-A), 1 +n represents 3 or more and 27 or less and m represents 16 or more and 31 or less.

The surfactant represented by general formula (2) in the present invention is a block copolymer including an ethylene oxide structure and a propylene oxide structure.

General formula (2)

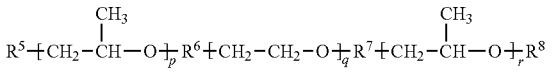

In the general formula (2), $R^5$ and $R^8$ each independently represent a hydrogen atom or an organic group. When $R^5$ and $R^8$ represent organic groups, each of the organic groups can be a hydroxyl group or a hydrocarbon group having 1 to 10 carbon atoms. When $R^5$ and $R^8$ represent hydrocarbon groups, each of the hydrocarbon groups may be linear or branched, but can be particularly linear. $R^5$ and $R^8$ preferably each independently represent a hydrogen atom, a hydroxyl group, or an alkyl group having 1 to 10 carbon atoms and more preferably each independently represent a hydrogen atom, a hydroxyl group, or a methyl group.

In the general formula (2), $R^6$ and $R^7$ each independently represent a single bond or an organic group. When $R^6$ and $R^7$ represent organic groups, each of the organic groups can be a divalent hydrocarbon group having 1 to 10 carbon atoms. When $R^6$ and $R^7$ represent hydrocarbon groups, each of the hydrocarbon groups may be linear or branched, but can be particularly linear. $R^6$ and $R^7$ preferably each independently represent a single bond or an alkylene group having 1 to 10 carbon atoms, more preferably each independently represent a single bond or a methylene group, and particularly preferably each independently represent a single bond.

In the general formula (2), p and r each independently represent 0 or more, and p+r represents 2 or more and 70 or less and preferably 2 or more and 60 or less.

In the general formula (2), q represents 1 or more and 300 or less and preferably 1 or more and 80 or less.

In the present invention, the surfactant represented by the general formula (2) can be a surfactant represented by general formula (2-A) below.

General formula (2-A)

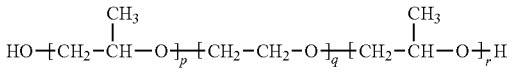

In the general formula (2-A), p+r represents 3 or more and 27 or less and q represents 16 or more and 31 or less.

In the image recording method according to an embodiment of the present invention, the content of the surfactants represented by the general formulae (1) and (2) in the ink is preferably 0.1% by mass or more and 30.0% by mass or less and more preferably 0.5% by mass or more and 10.0% by mass or less based on the total mass of the ink. If the content is less than 0.5% by mass, the surfactants do not sufficiently adsorb onto the surfaces of the polymer particles and thus an effect of improving the transfer efficiency is sometimes not sufficiently achieved. If the content is more than 10.0% by mass, the ejection stability of the ink is sometimes not sufficiently achieved. In the present invention, the expression "the content of the surfactants represented by the general formulae (1) and (2) in the ink" means the total content of at least one surfactant selected from a compound represented by general formula (1) and a compound represented by general formula (2).

Polymer Particles

In the present invention, the term "polymer particles" refers to a polymer that is dispersed in a solvent while having a particle diameter. In the present invention, a 50% cumulative volume mean diameter ($D_{50}$) of the polymer particles is preferably 10 nm or more and 1000 nm or less and more preferably 50 nm or more and 500 nm or less. In the present invention, $D_{50}$ of the polymer particles is measured by the following process: a polymer particle dispersion is diluted 50 fold (volume basis) with pure water and measurement is conducted using UPA-EX150 (manufactured by Nikkiso Co., Ltd.) under conditions of SetZero: 30 s, number of runs: 3, measurement time: 180 seconds, and refractive index: 1.5.

The polystyrene-equivalent weight-average molecular weight of the polymer particles determined by gel permeation chromatography (GPC) can be 1,000 or more and 2,000,000 or less.

The minimum film-forming temperature of the polymer particles can be 20° C. or higher and 100° C. or lower. The method for measuring the minimum film-forming temperature of the polymer particles in the present invention is in conformity with "Determination of minimum film-forming temperature" in JIS K 6828-2.

In the image recording method according to an embodiment of the present invention, the content of the polymer particles in the ink is preferably 0.5% by mass or more and 40.0% by mass or less and more preferably 1.0% by mass or more and 30.0% by mass or less based on the total mass of the ink.

In the image recording method according to an embodiment of the present invention, the mass ratio of the content of the polymer particles in the ink to the content of the surfactants represented by the general formulae (1) and (2) in the ink can be 1.0 or more and 6.7 or less on the basis of the total mass of the ink.

In the image recording method according to an embodiment of the present invention, the mass ratio of the content of the polymer particles in the ink to the content of a coloring material described below can be 0.1 or more and 30.0 or less on the basis of the total mass of the ink.

In the present invention, any polymer particles can be used for the ink as long as the above-described definition of polymer particles is satisfied. Any monomer can be used for the polymer particles as long as the monomer can be polymerized by emulsion polymerization, suspension polymerization, or dispersion polymerization. Examples of the polymer particles composed of different monomers include acrylic polymer particles, vinyl acetate-based polymer particles, ester-based polymer particles, ethylene-based polymer particles, urethane-based polymer particles, synthetic rubber-based polymer particles, vinyl chloride-based polymer particles, vinylidene chloride-based polymer particles, and olefin-based polymer particles. In particular, acrylic polymer particles and urethane polymer particles can be used.

Specific examples of monomers that can be used for the acrylic polymer particles include α,β-unsaturated carboxylic acids such as (meth)acrylic acid, maleic acid, crotonic acid, angelic acid, itaconic acid, and fumaric acid; salts of the α,β-unsaturated carboxylic acids; α,β-unsaturated carboxylic acid ester compounds such as ethyl (meth)acrylate, methyl (meth)acrylate, butyl (meth)acrylate, methoxyethyl (meth)acrylate, ethoxyethyl (meth)acrylate, diethylene glycol(meth)acrylate, triethylene glycol(meth)acrylate, tetraethylene glycol(meth)acrylate, polyethylene glycol(meth) acrylate, methoxydiethylene glycol(meth)acrylate, methoxytriethylene glycol(meth)acrylate, methoxytetraethylene glycol(meth)acrylate, methoxypolyethylene glycol (meth)acrylate, cyclohexyl (meth)acrylate, isobornyl (meth) acrylate, N,N-dimethylaminopropyl (meth)acrylate, monobutyl maleate, and dimethyl itaconate; α,β-unsaturated carboxylic acid alkylamide compounds such as (meth)acrylamide, dimethyl(meth)acrylamide, N,N-dimethylethyl (meth)acrylamide, N,N-dimethylpropyl(meth)acrylamide, isopropyl(meth)acrylamide, diethyl(meth)acrylamide, (meth)acryloyl morpholine, maleic acid monoamide, and crotonic acid methylamide; α,β-ethylenically unsaturated compounds having an aryl group, such as styrene, α-methylstyrene, vinyl phenyl acetate, benzyl (meth)acrylate, and 2-phenoxyethyl (meth)acrylate; and polyfunctional alcohol ester compounds such as ethylene glycol diacrylate and polypropylene glycol dimethacrylate. A single monomer may be polymerized to form a homopolymer or two or more types of monomers may be polymerized to form a copolymer. When the polymer particles are composed of a copolymer, the copolymer may be a random copolymer or a block copolymer. In particular, the polymer particles can be composed of a hydrophilic monomer and a hydrophobic monomer. Examples of the hydrophilic monomer include α,β-unsaturated carboxylic acids and salts thereof. Examples of the hydrophobic monomer include α,β-unsaturated carboxylic acid ester compounds and α,β-ethylenically unsaturated compounds having an aryl group.

The urethane polymer particles are polymer particles synthesized by causing a reaction between a polyisocyanate compound, which is a compound having two or more isocyanate groups, and a polyol compound, which is a compound having two or more hydroxyl groups. In the present invention, any urethane polymer particles synthesized by causing a reaction between a publicly known polyisocyanate compound and a publicly known polyol compound can be used as long as the above-described conditions of the polymer particles are satisfied.

The polymer particles are classified into polymer particles having a single-layer structure and polymer particles having a multilayer structure such as a core-shell structure. In the present invention, polymer particles having a multilayer structure can be used and polymer particles having a core-shell structure can be particularly used. When the polymer particles have a core-shell structure, the function is clearly divided between a core portion and a shell portion. Such polymer particles having a core-shell structure have an advantage in that many functions can be imparted to an ink compared with polymer particles having a single-layer structure.

Coloring Material

In the present invention, the ink may further contain a coloring material. Examples of the coloring material include pigments and dyes. Any publicly known pigments and dyes can be used. In the present invention, a pigment can be used from the viewpoint of water resistance of an image. The content of the coloring material is preferably 0.5% by mass or more and 15.0% by mass or less and more preferably 1.0% by mass or more and 10.0% by mass or less based on the total mass of the ink.

In the case where a pigment is used as a coloring material in the present invention, examples of the types of pigments that can be used in the form of dispersion include polymer dispersion type pigments that use polymers as dispersants (polymer-dispersion pigments that use polymer dispersants, microcapsule pigments constituted by pigment particles having polymer-coated surfaces, and polymer-bonded pigments in which organic groups that contain polymers are chemically bonded to surfaces of pigment particles) and self-dispersion type pigments in which hydrophilic groups are introduced to surfaces of pigment particles. Naturally, pigments with different dispersion forms can be used in combination. In particular, carbon black and organic pigments can be used as the pigments. The pigments can be used alone or in combination of two or more. When the pigment used in the ink is a polymer dispersion type pigment, a polymer is used as a dispersant. The polymer used as the dispersant can have a hydrophilic moiety and a hydrophobic moiety. Specific examples of such a polymer include acrylic polymers prepared by polymerizing carboxyl group-containing monomers such as acrylic acid and methacrylic acid; and urethane polymers prepared by polymerizing diols having anionic groups, such as dimethylolpropionic acid. The acid value of the polymer used as the dispersant can be 50 mgKOH/g or more and 550 mgKOH/g or less. The polystyrene-equivalent weight-average molecular weight (Mw) of the polymer used as the dispersant according to GPC can be 1,000 or more and 50,000 or less. The content of the polymer dispersant in the ink is 0.1% by mass or more and 10.0% by mass or less and preferably 0.2% by mass or more and 4.0% by mass or less based on the total mass of the ink. The mass ratio of the content of the polymer dispersant to the content of the pigment can be 0.1 or more and 3.0 or less.

Aqueous Medium

The ink according to an embodiment of the present invention may contain an aqueous medium such as water or a mixed solvent of water and a water-soluble organic solvent. The content of the water-soluble organic solvent can be 3.0% by mass or more and 50.0% by mass or less based on the total mass of the ink. Any commonly used water-soluble organic solvent can be used as the water-soluble organic solvent. Examples of the water-soluble organic solvent include alcohols, glycols, alkylene glycols having an alkylene group with 2 to 6 carbon atoms, polyethylene glycols, nitrogen-containing compounds, and sulfur-containing compounds. These water-soluble organic solvents may be optionally used alone or in combination of two or more. Deionized water (ion exchanged water) can be used as the water. The content of the water can be 50.0% by mass or more and 95.0% by mass or less based on the total mass of the ink.

Other Components

In addition to the above components, the ink according to an embodiment of the present invention may optionally contain water-soluble organic compounds which are solid at normal temperature, e.g., polyhydric alcohols such as trimethylolpropane and trimethylolethane, urea, and urea derivatives such as ethyleneurea. The ink according to an embodiment of the present invention may optionally further contain various additives such as a surfactant other than the compounds represented by the general formulae (1) and (2), a pH adjuster, an anticorrosive, a preservative, a fungicide, an antioxidant, a reducing inhibitor, an evaporation promoter, a chelating agent, and a polymer other than the polymer particles.

Liquid Composition-Applying Step

In the image recording method according to an embodiment of the present invention, a liquid composition-applying step of applying a liquid composition to the intermediate transfer body may be performed prior to the intermediate image-forming step. Examples of a method for applying a liquid composition to the intermediate transfer body include coating methods such as roller coating, bar coating, and spray coating and inkjet methods. In particular, coating methods can be used.

Liquid Composition

In the present invention, the liquid composition can be colorless, milk white, or white so as not to affect an image recorded with the ink. Therefore, the ratio of the maximum absorbance to the minimum absorbance (maximum absorbance/minimum absorbance) in a visible wavelength range of 400 nm to 800 nm can be 1.0 or more and 2.0 or less. This means that there are substantially no absorption peaks in a visible wavelength range or the peak intensity is extremely low even if there are absorption peaks. Furthermore, in the present invention, the liquid composition desirably does not contain a coloring material. The absorbance can be measured with Double Beam Spectrophotometer U-2900 (manufactured by Hitachi High-Technologies Corporation) using an undiluted liquid composition. Herein, the absorbance may be measured using a diluted liquid composition. This is because the maximum absorbance and the minimum absorbance of the liquid composition are both proportional to the dilution factor, and thus the ratio of the maximum absorbance to the minimum absorbance (maximum absorbance/minimum absorbance) is not dependent on the dilution factor.

In the present invention, the amount of the liquid composition applied can be 0.1 $g/m^2$ or more and 10.0 $g/m^2$ or less.

Reacting Agent

In the present invention, the liquid composition may contain a reacting agent that precipitates or aggregates components (e.g., coloring material and polymer) of the ink. A publicly known compound can be used as the reacting agent. In particular, at least one selected from polyvalent metal ions and organic acids can be used. The liquid composition can contain multiple types of reacting agents.

Specific examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$. In the present invention, the polyvalent metal ions can be added to the liquid composition in the form of salts such as a hydroxide and a chloride and may be used as dissociated ions. In the present invention, the content of the polyvalent metal ions can be 3% by mass or more and 90% by mass or less based on the total mass of the liquid composition.

Specific examples of the organic acids include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, oxysuccinic acid, and dioxysuccinic acid. In the present invention, the content of the organic acid can be 3% by mass or more and 99% by mass or less based on the total mass of the liquid composition.

Aqueous Medium

The liquid composition according to an embodiment of the present invention may contain an aqueous medium such as water or a mixed solvent of water and a water-soluble organic solvent. The content of the water-soluble organic solvent can be 3.0% by mass or more and 50.0% by mass or less based on the total mass of the liquid composition. Any commonly used water-soluble organic solvent can be used as the water-soluble organic solvent. Examples of the water-soluble organic solvent include alcohols, glycols, alkylene glycols having an alkylene group with 2 to 6 carbon atoms, polyethylene glycols, nitrogen-containing compounds, and sulfur-containing compounds. These water-soluble organic solvents may be optionally used alone or in combination of two or more. Deionized water (ion exchanged water) can be used as the water. The content of the water can be 50.0% by mass or more and 95.0% by mass or less based on the total mass of the liquid composition.

Other Components

In addition to the above components, the liquid composition according to an embodiment of the present invention may optionally contain water-soluble organic compounds which are solid at normal temperature, e.g., polyhydric alcohols such as trimethylolpropane and trimethylolethane, urea, and urea derivatives such as ethyleneurea. The liquid composition according to an embodiment of the present invention may optionally further contain various additives such as a surfactant, a pH adjuster, an anticorrosive, a preservative, a fungicide, an antioxidant, a reducing inhibitor, an evaporation promoter, a chelating agent, and a polymer.

Temperature Adjusting Step

In the image recording method according to an embodiment of the present invention, the temperature adjusting step includes adjusting the temperature of the intermediate image to a temperature higher than or equal to the minimum film-forming temperature of the polymer particles used in the ink. In the present invention, "the temperature of the intermediate image in the temperature adjusting step" means a temperature on a surface of the intermediate image after the start of the temperature adjusting step. Note that, in Examples of the present invention, the temperature of a region in which an intermediate image was formed was measured after the start of the temperature adjusting step using a noncontact infrared thermometer Digital Infrared Temperature Sensor FT-H20 (manufactured by KEYENCE CORPORATION).

The time over which the temperature of the intermediate image is kept at a temperature higher than or equal to the minimum film-forming temperature of the polymer particles is preferably 0.01 seconds or longer and 100 seconds or shorter and more preferably 0.01 seconds or longer and 10 seconds or shorter.

A method for adjusting the temperature of the intermediate image to a temperature higher than or equal to the minimum film-forming temperature of the polymer particles is, for example, heating with a heater. The case where the temperature of the intermediate image is naturally adjusted to a temperature higher than or equal to the minimum film-forming temperature of the polymer particles is also included in the temperature adjusting step.

In the image recording method according to an embodiment of the present invention, the temperature adjustment may be performed by a method common to "a liquid-removing step" described below and the temperature adjusting step. That is, a liquid may be removed by a method in which the temperature of the intermediate image is adjusted to a temperature higher than or equal to the minimum film-forming temperature of the polymer particles. In this case, such a step serves as both the temperature adjusting step and the liquid-removing step.

Liquid-Removing Step

In the image recording method according to an embodiment of the present invention, a liquid-removing step of removing a liquid from the intermediate image formed on the intermediate transfer body may be performed after the intermediate image-forming step and before the transfer step. If an excessive amount of liquid is contained in the intermediate image, for example, such an excessive amount of liquid flows out in the transfer step, which may degrade the quality of an image to be obtained. Therefore, an excessive amount of liquid can be removed from the intermediate image by employing the liquid-removing step. Examples of a method for removing a liquid include heating, sending low-humidity air, depressurizing, air drying, and combinations of the foregoing.

Transfer Step

In the transfer step of the image recording method according to an embodiment of the present invention, the intermediate image recorded on the intermediate transfer body is brought into contact with a recording medium while the temperature of the intermediate image is lower than the minimum film-forming temperature of the polymer particles, whereby the intermediate image is transferred onto the recording medium from the intermediate transfer body. Consequently, an image is recorded on the recording medium. In the present invention, "the temperature of the intermediate image in the transfer step" means a temperature on a surface of the intermediate image immediately before the transfer step. Note that, in Examples of the present invention, the temperature on a surface of the intermediate image was measured immediately before the transfer step using a noncontact infrared thermometer Digital Infrared Temperature Sensor FT-H20 (manufactured by KEYENCE CORPORATION).

In the transfer step, the temperature of the intermediate image is adjusted to a temperature lower than the minimum film-forming temperature of the polymer particles by, for example, a method in which the intermediate image is cooled after the temperature adjusting step and before the transfer step. If the temperature of the intermediate image naturally reaches a temperature lower than the minimum film-forming temperature of the polymer particles in the transfer step, no particular method is employed.

If the temperature of the intermediate image is lower than the minimum film-forming temperature of the polymer particles in the transfer step, the intermediate image may be heated. In the present invention, in the transfer step, the heating can be performed in such a manner that the temperature of the intermediate image is lower than the minimum film-forming temperature of the polymer particles. The intermediate image is heated by a method in which a roller is heated to a predetermined temperature or a method in which a heater is additionally disposed. The heating temperature in the transfer step is preferably set in accordance with the polymer particles used and more preferably 25° C. or higher and 200° C. or lower. In the present invention, the heating temperature in the transfer step is particularly preferably higher than or equal to a temperature 5° C. lower than the minimum film-forming temperature of the polymer particles used in the ink and lower than the minimum film-forming temperature.

When the intermediate image is transferred onto the recording medium, pressure can be applied from both sides of the intermediate transfer body and recording medium using, for example, a pressure roller. The application of pressure improves the transfer efficiency. Herein, the pressure may be applied through multiple stages.

As described above, with the increasing demand for high-speed recording, high transfer efficiency has been required even at a high transfer speed in recent years. Therefore, in the present invention, the transfer speed means a conveyance speed of a recording medium and is preferably 1.0 m/s or more and more preferably 2.0 m/s or more.

Recording Medium

In the present invention, the recording medium includes a variety of media such as cloth, plastic, and a film, in addition to paper generally used in printing. The recording medium used in the image recording method according to an embodiment of the present invention may be cut into a desired size in advance. A rolled sheet may be used, and such a rolled sheet may be cut into a desired size after image recording.

As described above, in the present invention, high transfer efficiency is achieved even for recording media having high surface roughness. Therefore, in order to achieve a higher effect of improving the transfer efficiency by applying the present invention, the arithmetic mean roughness of the surface of the recording medium, which is defined in JIS B 0601:2001, is preferably 1.0 μm or more and more preferably 2.0 μm or more.

Fixing Step

In the image recording method according to an embodiment of the present invention, a fixing step of applying pressure, with a fixing roller, to the recording medium onto which the intermediate image has been transferred may be performed after the transfer step. The application of pressure can improve the smoothness of an image.

When pressure is applied, with a fixing roller, to the recording medium onto which an image has been transferred, the fixing roller can be heated. By using a heated fixing roller in the application of pressure, the fastness of the image can be improved. Furthermore, by adjusting the heating temperature, the gloss of the image can be controlled. Specifically, a high-gloss image is obtained by performing heating fixation at a temperature higher than or equal to the minimum film-forming temperature of the polymer particles used in the ink and a low-gloss image is obtained by performing heating fixation at a temperature lower than the minimum film-forming temperature of the polymer particles used in the ink.

Cleaning Step

In the image recording method according to an embodiment of the present invention, a cleaning step of cleaning a surface of the intermediate transfer body may be performed after the transfer step. The intermediate transfer body can be cleaned by any publicly known method. Specific examples of the method include a method in which a cleaning liquid is sprayed onto the intermediate transfer body, a method in which a wetted damping roller is brought into contact with the intermediate transfer body to perform wiping, a method in which the intermediate transfer body is brought into contact with the surface of a cleaning liquid, a method in which residues on the intermediate transfer body are wiped off using a wiper blade, a method in which a certain energy is applied to the intermediate transfer body, and combinations of these methods.

EXAMPLES

The present invention will now be further described in detail based on Examples and Comparative Examples. Examples below do not limit the scope of the present invention. In Examples below, "part" means "part by mass" unless otherwise specified.

Preparation of Ink

Preparation of Pigment Dispersion

Ten parts of carbon black (trade name: MONARCH 1100, manufactured by Cabot Corporation), 15 parts of an aqueous polymer solution (styrene-ethyl acrylate-acrylic acid copolymer, manufactured by neutralizing an aqueous polymer solution having an acid value of 150, a weight-average molecular weight of 8000, and a polymer content of 20.0% by mass with an aqueous potassium hydroxide solution), and 75 parts of pure water were mixed with each other. The mixture was charged into a batch-type vertical sand mill (manufactured by AIMEX Co. Ltd.), 200 parts of zirconia beads having a diameter of 0.3 mm were filled therein, and the resulting mixture was dispersed for 5 hours under water cooling. The resulting dispersion liquid was centrifuged to remove coarse particles. As a result, a pigment dispersion having a pigment content of 10.0% by mass was obtained.

Preparation of Polymer Particle Dispersion

Preparation of Polymer Particle Dispersion 1

18 parts of ethyl methacrylate, 2 parts of 2,2'-azobis-(2-methylbutyronitrile), and 2 parts of n-hexadecane were mixed and stirred for 0.5 hours. The resulting mixture was added dropwise to 78 parts of a 6% aqueous solution of NIKKOL BC20 (manufactured by Nikko Chemicals Co., Ltd.) serving as an emulsifier, followed by stirring for 0.5 hours. Then, the resulting mixture was irradiated with ultrasonic waves for 3 hours using an ultrasonic irradiator. Then, a polymerization reaction was carried out in a nitrogen atmosphere at 85° C. for 3 hours and the resulting reaction product was cooled to room temperature and filtered to prepare a polymer particle dispersion 1 having a polymer content of 20.0% by mass. The minimum film-forming temperature was 100° C.

Preparation of Polymer Particle Dispersion 2

A polymer particle dispersion 2 having a polymer content of 20.0% by mass was prepared by using Hitec S-3121 (manufactured by TOHO CHEMICAL INDUSTRY Co., Ltd., minimum film-forming temperature: 77° C.)

Preparation of Surfactants

Surfactants listed in Tables 1 and 2 were prepared. These surfactants are manufactured by ADEKA Corporation.

TABLE 1

Surfactants represented by general formula (1)

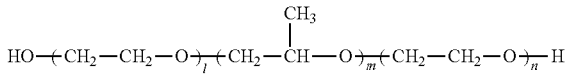

General formula (1-A)

| Surfactant No. | Product name | Ethylene oxide structure l + n | Propylene oxide structure m |
|---|---|---|---|
| Surfactant 1-1 | Pluronic L31 | 3.0 | 16.4 |
| Surfactant 1-2 | Pluronic L44 | 22.3 | 20.7 |
| Surfactant 1-3 | Pluronic L34 | 14.0 | 16.4 |
| Surfactant 1-4 | Pluronic L61 | 5.3 | 30.2 |

TABLE 2

Surfactants represented by general formula (2)

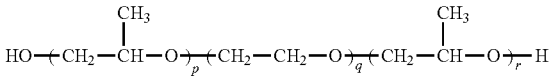

| Surfactant No. | Product name | Ethylene oxide structure q | Propylene oxide structure p + r |
|---|---|---|---|
| Surfactant 2-1 | Pluronic 17R-4 | 25.7 | 30.2 |
| Surfactant 2-2 | Pluronic 17R-2 | 16.6 | 30.2 |

Preparation of Ink

The prepared polymer particle dispersion and pigment dispersion were mixed with components listed below. The balance of ion exchanged water is an amount added so as to adjust the total content of all components constituting an ink to 100.0% by mass.

Pigment dispersion (content of coloring material: 10.0% by mass): 20.0% by mass

Polymer particle dispersion (content of polymer: 20.0% by mass): X % by mass in Table 3

Diethylene glycol: 12.0% by mass

Acetylenol E100 (surfactant manufactured by Kawaken Fine Chemicals Co., Ltd.): 0.5% by mass Surfactant: Y % by mass in Table 3

Ion exchanged water: balance

The resulting mixture was thoroughly stirred and dispersed, and then filtered under pressure using a microfilter (manufactured by FUJIFILM Corporation) having a pore size of 3.0 μm to prepare an ink.

TABLE 3

| Ink preparation conditions | | | | | | |
|---|---|---|---|---|---|---|
| | Polymer particle dispersion | | | Surfactant | | Polymer |
| Ink No. | Polymer particle dispersion No. | MFT (° C.) | Content X (mass %) | Surfactant No. | Content Y (mass %) | particles/ surfactant |
| Ink 1 | Polymer particle dispersion 1 | 100 | 50.0 | Surfactant 1-1 | 3.0 | 3.33 |
| Ink 2 | Polymer particle dispersion 1 | 100 | 50.0 | Surfactant 1-2 | 3.0 | 3.33 |
| Ink 3 | Polymer particle dispersion 1 | 100 | 50.0 | Surfactant 1-3 | 3.0 | 3.33 |
| Ink 4 | Polymer particle dispersion 1 | 100 | 50.0 | Surfactant 1-4 | 3.0 | 3.33 |
| Ink 5 | Polymer particle dispersion 1 | 100 | 50.0 | Surfactant 2-1 | 3.0 | 3.33 |
| Ink 6 | Polymer particle dispersion 1 | 100 | 50.0 | Surfactant 2-2 | 3.0 | 3.33 |
| Ink 7 | Polymer particle dispersion 1 | 100 | 50.0 | Surfactant 1-1 | 1.0 | 10.00 |
| Ink 8 | Polymer particle dispersion 1 | 100 | 50.0 | Surfactant 1-1 | 1.5 | 6.67 |
| Ink 9 | Polymer particle dispersion 1 | 100 | 50.0 | Surfactant 1-1 | 10.0 | 1.00 |
| Ink 10 | Polymer particle dispersion 1 | 100 | 50.0 | Surfactant 1-1 | 15.0 | 0.67 |
| Ink 11 | Polymer particle dispersion 1 | 100 | 25.0 | Surfactant 1-1 | 3.0 | 1.67 |
| Ink 12 | Polymer particle dispersion 1 | 100 | 15.0 | Surfactant 1-1 | 3.0 | 1.00 |
| Ink 13 | Polymer particle dispersion 2 | 77 | 50.0 | Surfactant 1-1 | 3.0 | 3.33 |
| Ink 14 | — | — | 0 | Surfactant 1-1 | 3.0 | 0 |
| Ink 15 | Polymer particle dispersion 1 | 100 | 50.0 | — | 0 | — |

Preparation of Liquid Composition

Components listed below were mixed with each other, and the mixture was thoroughly stirred and dispersed and then filtered under pressure using a microfilter (manufactured by FUJIFILM Corporation) having a pore size of 3.0 μm to prepare a liquid composition.

Levulinic acid: 45.0% by mass

Potassium hydroxide (neutralizing agent): 3.0% by mass

AQUACER 531 (modified polyethylene wax dispersion, manufactured by BYK Japan KK): 15.0% by mass Megaface F444 (perfluoroalkylethylene oxide adduct, manufactured by DIC Corporation): 3.0% by mass Ion exchanged water: 34.0% by mass Production of Intermediate Transfer Body A cylindrical drum composed of an aluminum alloy was used as a supporting member of an intermediate transfer body. A siloxane compound surface layer made of a hydrolyzable organic silicon compound was then disposed on a surface of the supporting member by the following method. First, glycidoxypropyltriethoxysilane and methyltriethoxysilane were mixed at a molar ratio of 1:1. The mixture was subjected to heat reflux in a water medium for over 24 hours using hydrochloric acid as a catalyst to obtain a hydrolyzable condensate solution. Subsequently, the hydrolyzable condensate solution was diluted with methyl isobutyl ketone to 10% to 20% by mass, and a photocationic polymerization initiator SP150 (manufactured by ADEKA Corporation) was added in an amount of 5% by mass based on the solid content to obtain a coating solution. The coating solution was applied by spin coating onto a surface of the supporting member subjected to a plasma treatment. Furthermore, the surface was exposed using a UV lamp and heated at 130° C. for three hours. As a result, an intermediate transfer body was produced. The thickness of the surface layer of the produced intermediate transfer body was about 0.3 μm.

Evaluation of Transfer Efficiency

Each of ink cartridges was filled with the above ink and liquid composition and then mounted on an image recording apparatus illustrated in FIGURE. First, the liquid composition was applied onto an intermediate transfer body using an application roller in an amount of 0.8 g/m$^2$. The ink was ejected from an inkjet recording head to the intermediate transfer body onto which the liquid composition was applied to record an intermediate image with a recording duty of 100% (solid image with a size of 1 cm×1 cm). In the image recording apparatus, conditions for applying a single ink droplet with 4 pl to a unit region with a size of 1/1200 inch×1/1200 inch at a resolution of 1200 dpi×1200 dpi are defined to be a recording duty of 100%. Subsequently, the temperature of the intermediate image was adjusted to a temperature (temperature $T_1$ of an intermediate image in a temperature adjusting step) shown in Table 4 with a heating mechanism and the temperature was held for at least one second. Furthermore, air at 25° C. was sent to the intermediate image for 60 seconds using a liquid removing unit. Subsequently, when the temperature of the intermediate image reached a predetermined temperature (transfer temperature $T_2$) shown in Table 4, the intermediate image was transferred onto a recording medium at a transfer speed of 2.0 m/s using a pressure roller. After a series of these steps were repeatedly performed 25 times, the proportion of the intermediate image remaining on a surface of the intermediate transfer body, that is, the transfer residual ratio (%) was calculated. Specifically, the transfer residual ratio was determined in such a manner that the intermediate transfer body was disengaged from the supporting member, the surface of the intermediate transfer body was captured as an image, and the percentage of the area of the intermediate image remaining on the intermediate transfer body without being transferred in the area where the intermediate image was recorded was calculated. The transfer efficiency was evaluated from the transfer residual ratio. Three types of recording media, namely, recording medium 1: Aurora Coat (manufactured by Nippon Paper Industries Co., Ltd.), recording medium 2: New V Matt (manufactured by Mitsubishi Paper Mills Ltd.), and recording medium 3: OK Prince High Quality (manufactured by Oji Paper Co., Ltd.), were used, and each of the recording media was evaluated in terms of transfer efficiency. The evaluation criteria are shown below. In the present invention, in the evaluation criteria, A and B were allowable levels and C was an unallowable level. Table 4 shows the evaluation results.

A: The transfer residual ratio was less than 3%, and the transfer efficiency was high.

B: The transfer residual ratio was 3% or more and less than 10%, and the transfer efficiency was relatively high.

C: The transfer residual ratio was 10% or more, and the transfer efficiency was low.

TABLE 4

| Evaluation result | | | | | | | |
|---|---|---|---|---|---|---|---|
| | | MFT (° C.) of polymer particles | Temperature $T_1$ (° C.) of intermediate image in temperature | Transfer temperature | Evaluation of transfer efficiency | | |
| Example No. | Ink No. | in ink | adjusting step | $T_2$ (° C.) | Recording medium 1 | Recording medium 2 | Recording medium 3 |
| Example 1 | Ink 1 | 100 | 120 | 60 | A | A | A |
| Example 2 | Ink 2 | 100 | 120 | 60 | A | A | A |
| Example 3 | Ink 3 | 100 | 120 | 60 | A | A | A |
| Example 4 | Ink 4 | 100 | 120 | 60 | A | A | A |
| Example 5 | Ink 5 | 100 | 120 | 60 | A | A | A |
| Example 6 | Ink 6 | 100 | 120 | 60 | A | A | A |
| Example 7 | Ink 7 | 100 | 120 | 60 | A | B | B |
| Example 8 | Ink 8 | 100 | 120 | 60 | A | A | A |
| Example 9 | Ink 9 | 100 | 120 | 60 | A | A | A |
| Example 10 | Ink 10 | 100 | 120 | 60 | A | A | A |
| Example 11 | Ink 11 | 100 | 120 | 60 | A | A | A |
| Example 12 | Ink 12 | 100 | 120 | 60 | B | B | B |
| Example 13 | Ink 13 | 77 | 100 | 60 | A | A | A |
| Comparative Example 1 | Ink 14 | — | 120 | 60 | C | C | C |
| Comparative Example 2 | Ink 15 | 100 | 120 | 60 | A | C | C |
| Comparative Example 3 | Ink 1 | 100 | 60 | 60 | B | C | C |
| Comparative Example 4 | Ink 1 | 100 | 120 | 120 | A | B | C |

According to the present invention, an image recording method with high transfer efficiency can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-125710, filed Jun. 14, 2013, which is hereby incorporated by reference herein in its entirety.

What is claimed is:

1. An image recording method comprising:

a liquid composition-applying step of applying a liquid composition containing a reacting agent that precipitates or aggregates components of an ink to an intermediate transfer body;

an intermediate image-forming step of forming an intermediate image by applying the ink to the intermediate transfer body;

a temperature adjusting step;

a liquid removing step of removing a liquid from the intermediate image formed on the intermediate transfer body; and a transfer step of transferring the intermediate image onto a recording medium, in this order, wherein the ink comprises polymer particles and a surfactant which is at least one selected from a compound represented by general formula (1) below and a compound represented by general formula (2) below, in the temperature adjusting step, a temperature of the intermediate image is adjusted to a temperature higher than or equal to a minimum film-forming temperature of the polymer particles, and a temperature of the intermediate image in the transfer step is lower than the minimum film-forming temperature of the polymer particles and a temperature difference between the temperature of the intermediate image in the transfer step and the minimum film-forming temperature of the polymer particles is 17° C. or more and 40° C. or less, General formula (1)

$$R^1\text{-}(CH_2\text{-}CH_2\text{-}O)_l\text{-}R^2\text{-}(CH_2\text{-}\overset{\overset{CH_3}{|}}{C}H\text{-}O)_m\text{-}R^3\text{-}(CH_2\text{-}CH_2\text{-}O)_n\text{-}R^4$$

where $R^1$ and $R^4$ each independently represent a hydrogen atom, a hydroxyl group, or a methyl group, $R^2$ and $R^3$ each independently represent a single bond or an organic group, l and n each independently represent 0 or more, l +n represents 2 or more and 300 or less, and m represents 1 or more and 70 or less, and General formula (2)

$$R^5\text{-}(CH_2\text{-}\overset{\overset{CH_3}{|}}{C}H\text{-}O)_p\text{-}R^6\text{-}(CH_2\text{-}CH_2\text{-}O)_q\text{-}R^7\text{-}(CH_2\text{-}\overset{\overset{CH_3}{|}}{C}H\text{-}O)_r\text{-}R^8$$

where $R^5$ and $R^8$ each independently represent a hydrogen atom, a hydroxyl group, or a methyl group, $R^6$ and $R^7$ each independently represent a single bond or an organic group, p and r each independently represent 0 or more, p +r represents 2 or more and 70 or less, and q represents 1 or more and 300 or less.

2. The image recording method according to claim 1, wherein a content of the surfactant in the ink is 0.5% by mass or more and 10.0% by mass or less based on the total mass of the ink.

3. The image recording method according to claim 1, wherein a content of the polymer particles in the ink is 1.0% by mass or more and 30.0% by mass or less based on the total mass of the ink.

4. The image recording method according to claim 1, wherein a mass ratio of a content of the polymer particles in the ink to a content of the surfactant is 1.0 or more and 6.7 or less based on the total mass of the ink.

5. The image recording method according to claim 1, wherein the compound represented by the general formula (1) is a compound represented by general formula (1-A):

General formula (1-A)

$$HO\text{-}(CH_2\text{-}CH_2\text{-}O)_l\text{-}(CH_2\text{-}\overset{\overset{CH_3}{|}}{C}H\text{-}O)_m\text{-}(CH_2\text{-}CH_2\text{-}O)_n\text{-}H$$

where l +n represents 3 or more and 27 or less and m represents 16 or more and 31 or less.

6. The image recording method according to claim 1, wherein the compound represented by the general formula (2) is a compound represented by general formula (2-A):

General formula (2-A)

$$HO\text{-}(CH_2\text{-}\overset{\overset{CH_3}{|}}{C}H\text{-}O)_p\text{-}(CH_2\text{-}CH_2\text{-}O)_q\text{-}(CH_2\text{-}\overset{\overset{CH_3}{|}}{C}H\text{-}O)_r\text{-}H$$

where p +r represents 3 or more and 27 or less and q represents 16 or more and 31 or less.

7. The image recording method according to claim 1, wherein a content of water in the ink is 50.0% by mass or more and 95.0% by mass or less based on the total mass of the ink.

8. The image recording method according to claim 1, wherein the reacting agent contains an organic acid.

9. The image recording method according to claim 1, wherein a content of the surfactant, which is at least one selected from the compounds represented by the general formulae (1) and (2), in the ink is 0.1% by mass or more and 3.0% or less.

10. The image recording method according to claim 1, wherein the surfactant is the compound represented by the general formula (2).

* * * * *